US008640495B2

(12) United States Patent
McNeil

(10) Patent No.: US 8,640,495 B2
(45) Date of Patent: Feb. 4, 2014

(54) SEPARATION OF CARBON MONOXIDE FROM GASEOUS MIXTURES CONTAINING CARBON MONOXIDE

(75) Inventor: Brian Alfred McNeil, Surrey (GB)

(73) Assignee: Ait Products and Chemicals, Inc., Allentown, PA (US)

( * ) Notice: Subject to any disclaimer, the term of this patent is extended or adjusted under 35 U.S.C. 154(b) by 1373 days.

(21) Appl. No.: 12/396,657

(22) Filed: Mar. 3, 2009

(65) Prior Publication Data

US 2010/0223952 A1 Sep. 9, 2010

(51) Int. Cl.
*F25J 3/00* (2006.01)

(52) U.S. Cl.
USPC ..... 62/622; 62/625; 62/920; 62/630

(58) Field of Classification Search
USPC ..... 62/622, 632, 920, 631, 635, 932, 934, 62/937
See application file for complete search history.

(56) References Cited

U.S. PATENT DOCUMENTS

| | | | | |
|---|---|---|---|---|
| 3,813,889 | A | 6/1974 | Allam et al. | |
| 4,217,759 | A | 8/1980 | Shenoy | |
| 4,311,496 | A | 1/1982 | Fabian | |
| 4,478,621 | A * | 10/1984 | Fabian | 62/630 |
| 4,566,886 | A | 1/1986 | Fabian et al. | |
| 4,888,035 | A | 12/1989 | Bauer | |
| 4,917,716 | A | 4/1990 | Schmid et al. | |
| 5,133,793 | A | 7/1992 | Billy | |
| 5,295,356 | A | 3/1994 | Billy | |
| 5,351,491 | A | 10/1994 | Fabian | |
| 5,351,492 | A | 10/1994 | Agrawal et al. | |
| 5,359,857 | A | 11/1994 | Honda | |
| 5,509,271 | A | 4/1996 | Billy et al. | |
| 5,592,831 | A | 1/1997 | Bauer et al. | |
| 5,609,040 | A | 3/1997 | Billy et al. | |
| 5,953,936 | A | 9/1999 | Agrawal et al. | |
| 6,062,042 | A * | 5/2000 | McNeil et al. | 62/625 |
| 6,070,430 | A * | 6/2000 | McNeil et al. | 62/620 |
| 6,073,461 | A * | 6/2000 | McNeil et al. | 62/625 |
| 6,082,134 | A | 7/2000 | McNeil et al. | |
| 6,094,938 | A | 8/2000 | McNeil et al. | |
| 6,098,424 | A | 8/2000 | Gallarda et al. | |
| 6,173,585 | B1 | 1/2001 | Billy et al. | |
| 6,269,657 | B1 | 8/2001 | McNeil | |
| 6,467,306 | B2 | 10/2002 | McNeil | |
| 7,269,972 | B2 | 9/2007 | Davey | |

FOREIGN PATENT DOCUMENTS

| | | |
|---|---|---|
| DE | 19541339 B4 | 8/2006 |

* cited by examiner

*Primary Examiner* — Frantz Jules
*Assistant Examiner* — Webeshet Mengesha
(74) *Attorney, Agent, or Firm* — Bryan C. Hoke, Jr.

(57) ABSTRACT

A process and apparatus for producing a carbon monoxide-containing product from a feed containing hydrogen, carbon monoxide, methane, nitrogen and optionally argon. The carbon monoxide-containing product is produced using a hydrogen stripping column for forming a hydrogen-enriched vapor and a hydrogen-freed liquid, a nitrogen separation fractionator for forming a nitrogen-enriched vapor and a nitrogen-depleted liquid containing carbon monoxide and methane from the hydrogen-freed liquid, and a carbon monoxide/methane separation fractionator for forming the carbon monoxide containing product and a methane-enriched liquid from the nitrogen-depleted liquid. At least part of the nitrogen separation fractionator condenser duty provides the feed vaporization duty and reboiler duty for the carbon monoxide/methane separation fractionator, thereby reducing the energy requirement for the separation.

11 Claims, 1 Drawing Sheet

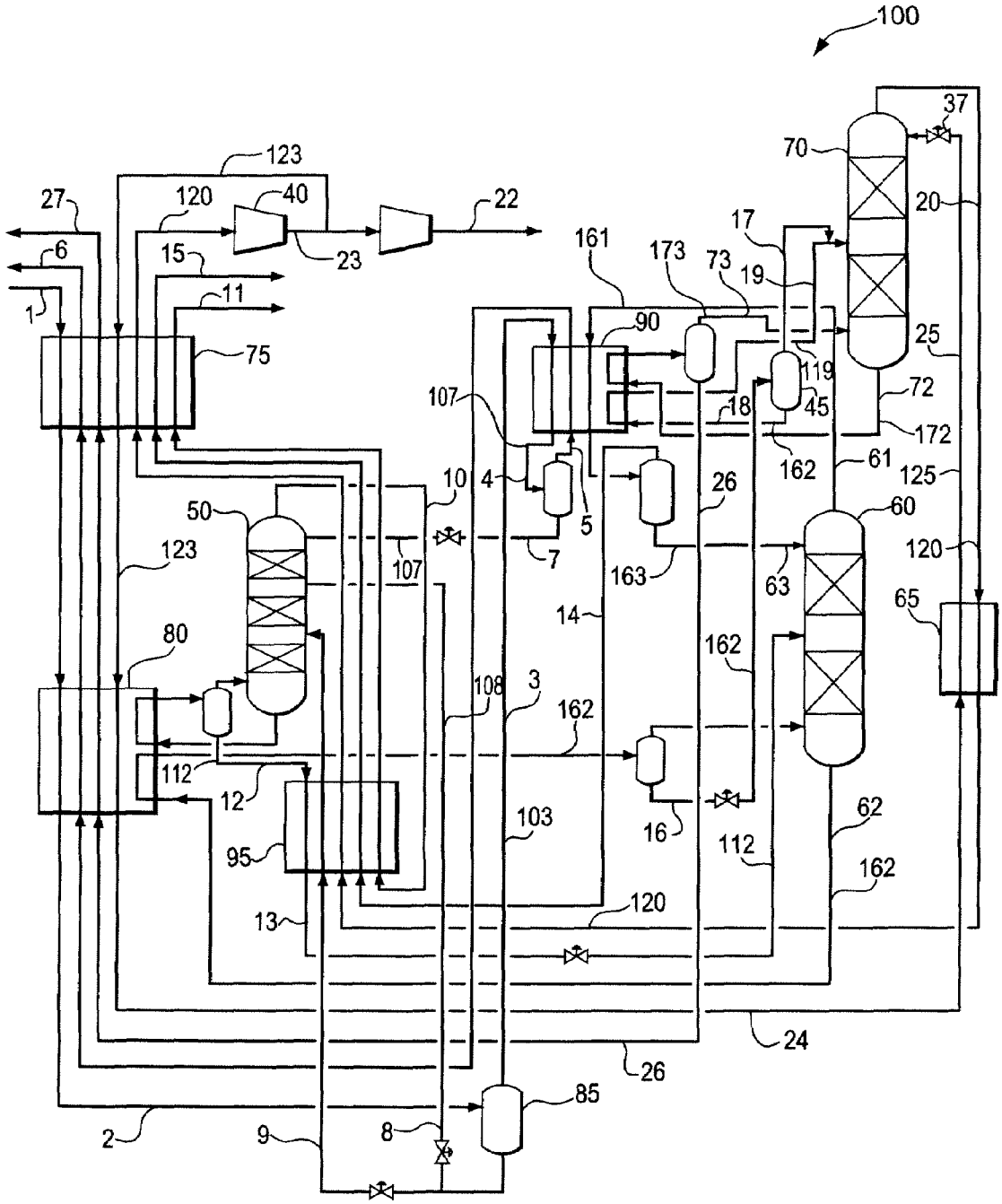
100
37
70
123
27
120
40
22
20
6
15
23
161
173
73
17
19
1
11
90
25
75
119
107
18
45
72
172
162
61
125
10
4
26
50
5
60
123
107
7
163
63
120
65
14
80
162
108
3
162
112
12
16
62
103
95
112
162
13
120
24
26
85
2
9
8

SEPARATION OF CARBON MONOXIDE FROM GASEOUS MIXTURES CONTAINING CARBON MONOXIDE

BACKGROUND

Carbon monoxide is usually obtained by separation from synthesis gases produced by catalytic conversion or partial oxidation of natural gas, oils or other hydrocarbon feedstock. In addition to carbon monoxide, these gases contain primarily hydrogen and methane but are often contaminated with significant amounts of nitrogen (derived from the feed or added during processing). Conventional cryogenic separation processing leaves nitrogen as an impurity in the carbon monoxide, which, for both environmental and processing reasons, is unacceptable for some uses of carbon monoxide. The problem of nitrogen contamination of carbon monoxide product is becoming an increasing problem with the usage of more marginal feedstock in front end reforming processes. Further, there is an increasing demand for carbon monoxide to be free of argon, which sometimes is a co-contaminant with nitrogen. Accordingly, there is a demand for efficient and effective removal of contaminant nitrogen and, if required, argon from carbon monoxide-containing feeds.

The separation of nitrogen alone or with argon co-contaminant from carbon monoxide is relatively difficult compared to removal of hydrogen or methane. Prior art processes for removing nitrogen from synthesis gas usually include the sequential steps of removing hydrogen from the synthesis gas feed, removing methane from the resultant hydrogen-freed stream, and removing nitrogen from the resultant hydrogen- and methane-freed stream to leave a purified carbon monoxide product stream.

Related patents for producing carbon monoxide include U.S. Pat. Nos. 3,813,889, 4,217,759, 4,311,496, 4,478,621, 4,566,886, 4,888,035, 4,917,716 5,133,793, 5,295,356, 5,351,491, 5,351,492, 5,359,857, 5,509,271, 5,592,831, 5,609,040, 5,953,936, 6,073,461, 6,062,042, 6,070,430, 6,082,134, 6,094,938, 6,098,424, 6,173,585, 6,269,657, 6,467,306, 7,269,972, and German No. DE 195 41 339, all incorporated herein by reference.

It would be desirable to provide a more cost effective process for separating carbon monoxide from gaseous mixtures containing carbon monoxide, hydrogen, methane and nitrogen, especially those which also contain argon.

BRIEF SUMMARY

The present invention relates to a process and apparatus for producing a carbon monoxide-containing product from a feed containing hydrogen, carbon monoxide, methane, nitrogen and optionally argon.

The process comprises:

partially condensing the feed to provide a first hydrogen-enriched vapor fraction and a first hydrogen-depleted liquid fraction;

stripping hydrogen from the first hydrogen-depleted liquid fraction in a first fractionator to form a second hydrogen-enriched vapor fraction and a hydrogen-freed liquid fraction;

separating at least a portion of the hydrogen-freed liquid fraction in a second fractionator to form a nitrogen-enriched vapor fraction and a nitrogen-depleted liquid fraction containing carbon monoxide and methane;

separating an at least partially vaporized feed containing carbon monoxide and methane in a third fractionator to form the carbon monoxide-containing product and a methane-enriched liquid fraction;

cooling a portion or all of the nitrogen-enriched vapor fraction by indirect heat exchange with a portion of the nitrogen-depleted liquid fraction and by indirect heat exchange with a portion or all of the methane-enriched liquid fraction to form a condensate from the portion or all of the nitrogen-enriched vapor fraction, and to form the at least partially vaporized feed from the portion of the nitrogen-depleted liquid fraction, and to form a vapor boil-up and a methane-containing bottoms product from the portion or all of the methane-enriched liquid fraction;

introducing at least a portion of the vapor boil-up to the third fractionator to provide stripping vapor; and introducing at least a portion of the condensate to the second fractionator as reflux.

The process may further comprise:

partially condensing the first hydrogen-enriched vapor fraction by indirect heat exchange against one or more process streams to form a hydrogen-containing condensate, and introducing at least a portion of the hydrogen-containing condensate to the first fractionator as reflux.

Alternatively or additionally, the process may further comprise:

compressing a portion or all of the carbon monoxide-containing product to form a compressed carbon monoxide-containing product;

at least partially condensing a portion of the compressed carbon monoxide-containing product to form a condensed carbon monoxide-containing stream; and introducing at least a portion of the condensed carbon monoxide-containing stream into the third fractionator as reflux.

Alternatively or additionally, the feed may be partially condensed to further form a second hydrogen-depleted liquid fraction in addition to the first hydrogen-enriched vapor fraction and the first hydrogen-depleted liquid fraction. The process may then further comprise:

introducing the first hydrogen-depleted liquid fraction into the first fractionator at a first location; and introducing the second hydrogen-depleted liquid fraction into the first fractionator at a second location below the first location.

Alternatively or additionally, the process may further comprise:

heating the second hydrogen-depleted liquid fraction prior to introducing the second hydrogen-depleted liquid fraction into the first fractionator.

Alternatively or additionally, the at least partially vaporized feed may further contain argon and some argon may be removed in the methane-enriched liquid fraction.

The apparatus for producing a carbon monoxide-containing product from a feed containing hydrogen, carbon monoxide, methane and nitrogen by the process comprises:

a first heat exchanger for cooling and partially condensing the feed to produce a cooled and partially condensed feed;

a separator for separating the cooled and partially condensed feed to produce a first hydrogen-enriched vapor fraction and a first hydrogen-depleted liquid fraction;

a first fractionator for stripping hydrogen from the first hydrogen-depleted liquid to form a second hydrogen-enriched vapor fraction and a hydrogen-freed liquid fraction from the first hydrogen-depleted liquid fraction;

a first conduit constructed and arranged to introduce the first hydrogen-depleted liquid fraction from the separator to the first fractionator;

a second fractionator for separating at least a portion of the hydrogen-freed liquid fraction to form a nitrogen-enriched vapor fraction and a nitrogen-depleted liquid fraction containing carbon monoxide and methane;

a second conduit constructed and arranged to introduce the at least a portion of the hydrogen-freed liquid fraction from the first fractionator to the second fractionator;

a third fractionator for separating an at least partially vaporized feed containing carbon monoxide and methane to form the carbon monoxide-containing product and a methane-enriched liquid fraction;

a second heat exchanger for cooling a portion or all of the nitrogen-enriched vapor fraction by indirect heat exchange with a portion of the nitrogen-depleted liquid fraction and by indirect heat exchange with a portion or all of the methane-enriched liquid fraction to form a condensate from the portion or all of the nitrogen-enriched vapor fraction, and to form the at least partially vaporized feed from the portion of the nitrogen-depleted liquid fraction, and to form a vapor boil-up and a methane-containing bottoms product from the portion or all of the methane-enriched liquid fraction;

a third conduit constructed and arranged to introduce the portion of the nitrogen-depleted liquid fraction to the second heat exchanger;

a fourth conduit constructed and arranged to introduce the at least partially vaporized feed from the second heat exchanger to an intermediate portion of the third fractionator;

a fifth conduit constructed and arranged to introduce the portion or all of the methane-enriched liquid fraction from the third fractionator to the second heat exchanger;

a sixth conduit constructed and arranged to introduce the vapor boil-up from the second heat exchanger to the third fractionator to provide stripping vapor;

a seventh conduit constructed and arranged to introduce the portion or all of the nitrogen-enriched vapor fraction from the second fractionator to the second heat exchanger; and an eighth conduit constructed and arranged to introduce the condensate from the second heat exchanger to the second fractionator as reflux.

The second heat exchanger may partially condense the first hydrogen-enriched vapor fraction by indirect heat exchange with the portion of the nitrogen-depleted liquid fraction and the portion or all of the methane-enriched liquid fraction to form a hydrogen-containing condensate from the first hydrogen-enriched vapor fraction. The apparatus may then further comprise:

a ninth conduit constructed and arranged to introduce the first hydrogen-enriched vapor fraction from the separator to the second heat exchanger; and a tenth conduit constructed and arranged to introduce the hydrogen-containing condensate from the second heat exchanger to the first fractionator as reflux.

Alternatively or additionally, the apparatus may further comprise:

a compressor for compressing a portion or all of the carbon monoxide-containing product to form a compressed carbon monoxide-containing product;

an eleventh conduit constructed and arranged to introduce the portion or all of the carbon monoxide-containing product from the third fractionator to the compressor;

a twelfth conduit constructed and arranged to introduce a portion of the compressed carbon monoxide-containing product from the compressor to the first heat exchanger for at least partially condensing the portion of the compressed carbon monoxide-containing product to form a carbon monoxide-containing condensate; and a thirteenth conduit constructed and arranged to introduce the carbon monoxide-containing condensate from the first heat exchanger to the third fractionator as reflux.

Alternatively or additionally, the apparatus may further comprise:

an expansion means arranged between the first heat exchanger and the third fractionator to partially flash the carbon monoxide-containing condensate.

BRIEF DESCRIPTION OF THE DRAWING

The FIGURE illustrates an exemplary process flow diagram 100 for the present invention.

DETAILED DESCRIPTION

The articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

The phrase "at least a portion" means "a portion or all."

For the purposes of simplicity and clarity, detailed descriptions of well-known devices, circuits, and methods are omitted so as not to obscure the description of the present invention with unnecessary detail.

As used herein a "fractionator" includes such devices as distillation columns, flash drums, rectification columns, stripping columns and the like.

The present invention will be better understood with reference to the FIGURE, which shows an exemplary embodiment and is intended to illustrate, but not to limit the scope of the invention, the invention being defined by the claims.

The process and apparatus are for producing a carbon monoxide-containing product from a feed containing hydrogen, carbon monoxide, methane, nitrogen and optionally argon.

The feed 1, containing hydrogen, carbon monoxide, methane, nitrogen and optionally argon is cooled and partially condensed to provide a hydrogen-enriched vapor fraction 3 and a hydrogen-depleted liquid fraction 8. Feed 1 may be cooled in heat exchanger 75 and/or heat exchanger 80 to partially condense the feed to produce a cooled and partially condensed feed 2, and subsequently separated in separator 85 to form the hydrogen-enriched vapor fraction 3 and the hydrogen-depleted liquid fraction 8 as shown in the FIGURE.

The term "enriched" means having a greater mole % concentration of the indicated gas than the original stream from which it was formed.

The term "depleted" means having a lesser mole % concentration of the indicated gas than the original stream from which it was formed.

Then, the hydrogen-enriched vapor fraction has a greater hydrogen mole % concentration than the feed and the hydrogen-depleted liquid has a lesser hydrogen mole % than the feed.

Since the articles "a" and "an" as used herein mean one or more when applied to any feature, more than one hydrogen-depleted liquid fraction may be formed from feed 1.

Feed 1 may be partially condensed to also form hydrogen-depleted liquid fraction 9 in addition to hydrogen-enriched vapor fraction 3 and hydrogen-depleted liquid fraction 8. After vapor/liquid separation in separator 85, the liquid may be divided into hydrogen-depleted liquid fraction 8 and hydrogen-depleted liquid fraction 9. Hydrogen-depleted liquid fraction 9 may be heated in heat exchanger 95. Hydrogen-depleted liquid fraction 8 is introduced into fractionator 50 and hydrogen-depleted liquid fraction 9 may be introduced into fractionator 50 at a location below where hydrogen-depleted liquid fraction 8 is introduced.

Fractionator 50 may be operated within a pressure range of 1 to 3 MPa and a temperature within a temperature range of −180° C. to −140° C.

A conduit 108 is constructed and arranged to introduce hydrogen-depleted liquid fraction 8 from separator 85 to fractionator 50.

A "conduit" is any channel through which a fluid may be conveyed, for example, a pipe, tube, duct or the like. A conduit provides fluid flow communication between various devices.

Hydrogen-enriched vapor fraction 3 is cooled by indirect heat exchange in heat exchanger 90. Hydrogen-enriched vapor fraction 3 is partially condensed to form hydrogen-containing condensate 7. Hydrogen-containing condensate 7 is introduced to a top portion of fractionator 50 as reflux. Conduit 103 is constructed and arranged to introduce hydrogen-enriched vapor fraction 3 from separator 85 to heat exchanger 90. Conduit 107 is constructed and arranged to introduce hydrogen-containing condensate 7 from heat exchanger 90 to a top portion of fractionator 50 as reflux.

Hydrogen is stripped from the hydrogen-depleted liquid fraction 8 and optional hydrogen-depleted liquid fraction 9 in fractionator 50 to form a hydrogen-enriched vapor fraction 10 and a hydrogen-freed liquid fraction 12. Vapor boil-up may be provided by heating bottoms liquid from the fractionator 50 in heat exchanger 80.

As used herein, "hydrogen-freed" means containing less than 1 mole % hydrogen.

As shown in the FIGURE, at least a portion of hydrogen-freed liquid fraction 12 is cooled in heat exchanger 95 and passed to fractionator 60. Conduit 112 is constructed and arranged to introduce at least a portion of hydrogen-freed liquid fraction 12 from fractionator 50 to fractionator 60. Since the articles "a" and "an" as used herein mean one or more when applied to any feature, more than one conduit may be used to introduce hydrogen-freed liquid fraction 12 from fractionator 50 to fractionator 60. As shown in the FIGURE, intervening devices, like valves and heat exchanger 95, may be present.

At least a portion of hydrogen-freed liquid fraction 12 is separated in fractionator 60 to form nitrogen-enriched vapor fraction 61 and nitrogen-depleted liquid fraction 62. Nitrogen-depleted liquid fraction 62 contains carbon monoxide and methane.

Fractionator 60 may be operated within a pressure range of 0.3 to 1.5 MPa and a temperature within a temperature range of −190° C. to −150° C.

A portion or all of nitrogen-depleted liquid fraction 62 is heated in heat exchanger 80, vapor boil-up is provided back to fractionator 60 and liquid is passed to separator 45.

A portion or all of the nitrogen-enriched vapor fraction 61 is cooled by indirect heat exchange with a portion of the nitrogen-depleted liquid fraction 62 in heat exchanger 90. An at least partially vaporized feed 19 is formed from the portion of the nitrogen-depleted liquid fraction 62 via heat exchanger 80, separator 45 and heat exchanger 90. The at least partially vaporized feed 19 is passed to fractionator 70.

Since the articles "a" and "an" as used herein mean one or more when applied to any feature, each of the various heat exchangers may be divided into more than single heat exchanger shown in the FIGURE.

While multiple streams are shown to be heated/cooled in a heat exchanger, the streams could be divided and passed through multiple heat exchangers with the same effect.

Conduit 162 is constructed and arranged to introduce the portion of nitrogen-depleted liquid fraction 62 to heat exchanger 90. Conduit 119 is constructed and arranged to introduce at least partially vaporized feed 19 from heat exchanger 90 to an intermediate portion of fractionator 70.

A vapor fraction 17 formed from nitrogen-depleted liquid fraction 62 is passed from separator 45 to fractionator 70.

The at least partially vaporized feed 19, which contains carbon monoxide and methane, is separated in fractionator 70 to form carbon monoxide-containing product 20 and methane-enriched liquid fraction 72. Fractionator 70 may be operated within a pressure range of 0.2 to 0.5 MPa and a temperature within a temperature range of −190° C. to −160° C.

The at least partially vaporized feed 19 may further contain argon and a portion of the argon may be removed in the methane-enriched liquid fraction 72.

A portion or all of the nitrogen-enriched vapor fraction 61 is cooled by indirect heat exchange with a portion or all of methane-enriched liquid fraction 72. Vapor boil-up 73 and methane-containing bottoms product 26 are formed from the portion or all of methane-enriched liquid fraction 72. At least a portion of vapor boil-up 73 is introduced into a bottom portion of fractionator 70 to provide stripping vapor.

Cooling a portion or all of the nitrogen-enriched vapor fraction 61 by indirect heat exchange with both the portion of the nitrogen-depleted liquid fraction 62 and the portion or all of the methane-enriched liquid fraction 72 has been found to reduce the energy requirement for the separation and production of the carbon monoxide product from a mixture containing carbon monoxide, methane, nitrogen, hydrogen and optionally argon.

Conduit 172 is constructed and arranged to introduce a portion or all of methane-enriched liquid fraction 72 from fractionator 70 to heat exchanger 90. Conduit 173 is constructed and arranged to introduce vapor boil-up 73 from heat exchanger 90 to a bottom portion of fractionator 70 to provide stripping vapor. Conduit 161 is constructed and arranged to introduce a portion or all of nitrogen-enriched vapor fraction 61 from fractionator 60 to heat exchanger 90.

The portion or all of nitrogen-enriched vapor fraction 61, which is cooled in heat exchanger 90, forms condensate 63. At least a portion of condensate 63 is introduced into fractionator 60 as reflux. Conduit 163 is constructed and arranged to introduce condensate 63 from heat exchanger 90 to a top portion of fractionator 60 as reflux.

A portion or all of carbon monoxide-containing product 20 is compressed in compressor 40 to form a compressed carbon monoxide-containing product 23. A portion of compressed carbon monoxide-containing product 23 is condensed in at least one of heat exchangers 75, 80 and 65 to form condensed carbon monoxide-containing stream 25. At least a portion of condensed carbon monoxide-containing stream 25 is introduced into a top portion of fractionator 70 to provide reflux. Conduit 120 is constructed and arranged to introduce the portion or all of carbon monoxide-containing product 20 from fractionator 70 to compressor 40. Conduit 123 is constructed and arranged to introduce a portion of compressed carbon monoxide-containing product 23 from compressor 40 to heat exchanger 80. Conduit 125 is constructed and arranged to introduce carbon monoxide-containing condensate 25 from heat exchanger 80 to a top portion of fractionator 70 as reflux.

Condensed carbon monoxide-containing stream 25 is partially flashed using an expansion means 37 prior to introducing the condensed carbon monoxide-containing stream 25 into fractionator 70. Expansion means 37 may be a valve, orifice plate or other known means for expanding a fluid.

The inventors have discovered that by providing reboiler duties for fractionators 60 and 70 in series, the carbon monoxide recycle compressor size and power may be reduced by as much as 50%. Fractionator 60 is reboiled in heat exchanger 80 and the resulting vapor from the top of fractionator 60 is condensed in heat exchanger 90, thereby providing reboiler duty and feed vaporizing duty for fractionator 70. Others have taught to reboil these columns in parallel against a heat pump stream.

EXAMPLE

The process shown in the FIGURE was simulated using Aspen Plus® 2004.1. Table 1 summarizes the mass balance for streams referred to in the process flow diagram of the FIGURE. For the vapor fraction, 1 means all vapor, and 0 means all liquid.

Modeling studies have shown that there is a significant reduction (about 50%) in the overall compression power requirement.

The process of the present invention reduces the cost and improves the efficiency of cryogenic carbon monoxide separation by reducing the size of compressor 40

TABLE 1

| | Stream | | | | | | |
|---|---|---|---|---|---|---|---|
| Parameter | 1 | 2 | 3 | 4 | 5 | 6 | 7 |
| $H_2$ (mole %) | 50.22 | 50.22 | 78.92 | 78.92 | 86.70 | 86.70 | 15.11 |
| $N_2$ (mole %) | 0.49 | 0.49 | 0.26 | 0.26 | 0.19 | 0.19 | 0.83 |
| CO (mole %) | 48.98 | 48.98 | 20.74 | 20.74 | 13.07 | 13.07 | 83.64 |
| Ar (mole %) | 0.18 | 0.18 | 0.07 | 0.07 | 0.04 | 0.04 | 0.30 |
| $CH_4$ (mole %) | 0.13 | 0.13 | 0.02 | 0.02 | 0.00 | 0.00 | 0.12 |
| Flow rate (kgmol/h) | 1364.0 | 1364.0 | 739.8 | 739.8 | 659.4 | 659.4 | 80.4 |
| Pressure (MPa) | 6.27 | 6.20 | 6.19 | 6.18 | 6.18 | 6.12 | 6.18 |
| Temperature (° C.) | 35.8 | −172.2 | −172.1 | −180.1 | −180.0 | 32.2 | −180.0 |
| Vapor fraction (mole) | 1.0 | 0.5194 | 1.0 | 0.8906 | 1.0 | 1.0 | 0.0 |

| | Stream | | | | | | |
|---|---|---|---|---|---|---|---|
| Parameter | 8 | 9 | 10 | 11 | 12 | 13 | 14 |
| $H_2$ (mole %) | 16.19 | 16.19 | 72.67 | 72.67 | 0.25 | 0.25 | 21.43 |
| $N_2$ (mole %) | 0.76 | 0.76 | 0.38 | 0.38 | 0.87 | 0.87 | 32.36 |
| CO (mole %) | 82.46 | 82.46 | 26.87 | 26.87 | 98.17 | 98.17 | 46.20 |
| Ar (mole %) | 0.32 | 0.32 | 0.07 | 0.07 | 0.39 | 0.39 | 0.00 |
| $CH_4$ (mole %) | 0.27 | 0.27 | 0.01 | 0.01 | 0.32 | 0.32 | 0.00 |
| Flow rate (kgmol/h) | 545.1 | 79.1 | 154.0 | 154.0 | 550.6 | 550.6 | 6.3 |
| Pressure (MPa) | 2.68 | 2.68 | 2.61 | 2.57 | 2.62 | 2.61 | 0.51 |
| Temperature (° C.) | −172.8 | −172.8 | −173.8 | 32.2 | −146.9 | −172.7 | −179.6 |
| Vapor fraction (mole) | 0.1573 | 0.1573 | 1.0 | 1.0 | 0.0 | 0.0 | 1.0 |

| | Stream | | | | | | |
|---|---|---|---|---|---|---|---|
| Parameter | 15 | 16 | 17 | 18 | 19 | 20 | 21 |
| $H_2$ (mole %) | 21.43 | 0.00 | 0.00 | 0.00 | 0.00 | 0.00 | 0.00 |
| $N_2$ (mole %) | 32.36 | 0.51 | 0.77 | 0.48 | 0.48 | 0.51 | 0.51 |
| CO (mole %) | 46.20 | 98.78 | 98.91 | 98.76 | 98.76 | 99.10 | 99.10 |
| Ar (mole %) | 0.00 | 0.40 | 0.28 | 0.41 | 0.41 | 0.39 | 0.39 |
| $CH_4$ (mole %) | 0.00 | 0.32 | 0.04 | 0.35 | 0.35 | 0.00 | 0.00 |
| Flow rate (kgmol/h) | 6.3 | 544.3 | 46.2 | 498.1 | 498.1 | 661.3 | 661.3 |
| Pressure (MPa) | 0.47 | 0.52 | 0.28 | 0.28 | 0.29 | 0.28 | 0.23 |
| Temperature (° C.) | 35.4 | −173.8 | −181.2 | −181.2 | −180.4 | −181.5 | 35.4 |
| Vapor fraction (mole) | 1.0 | 0.0 | 1.0 | 0.0 | 1.0 | 1.0 | 1.0 |

| | Stream | | | | | |
|---|---|---|---|---|---|---|
| Parameter | 22 | 23 | 24 | 25 | 26 | 27 |
| $H_2$ (mole %) | 0.00 | 0.00 | 0.00 | 0.00 | 0.00 | 0.00 |
| $N_2$ (mole %) | 0.51 | 0.51 | 0.51 | 0.51 | 0.02 | 0.02 |
| CO (mole %) | 99.10 | 99.10 | 99.10 | 99.10 | 43.44 | 43.44 |
| Ar (mole %) | 0.39 | 0.39 | 0.39 | 0.39 | 1.27 | 1.27 |
| $CH_4$ (mole %) | 0.00 | 0.00 | 0.00 | 0.00 | 55.27 | 55.27 |
| Flow rate (kgmol/h) | 540.2 | 661.3 | 120.1 | 120.1 | 3.2 | 3.2 |
| Pressure (MPa) | 1.24 | 0.68 | 0.64 | 0.57 | 0.28 | 0.26 |
| Temperature (° C.) | 37.3 | 37.3 | −171.3 | −180.3 | −173.6 | 35.4 |
| Vapor fraction (mole) | 1.0 | 1.0 | 0.0 | 0.0 | 0.0 | 1.0 |

TABLE 1-continued

| Parameter | Stream 61 | 62 | 63 | 72 | 73 |
|---|---|---|---|---|---|
| $H_2$ (mole %) | 0.56 | 0.00 | 0.34 | 0.00 | 0.00 |
| $N_2$ (mole %) | 32.44 | 0.63 | 32.44 | 0.07 | 0.07 |
| CO (mole %) | 66.99 | 98.85 | 67.22 | 88.82 | 90.22 |
| Ar (mole %) | 0.00 | 0.34 | 0.00 | 1.59 | 1.60 |
| $CH_4$ (mole %) | 0.00 | 0.18 | 0.00 | 9.53 | 8.11 |
| Flow rate (kgmol/h) | 595.6 | 1133.9 | 589.3 | 104.7 | 101.5 |
| Pressure (MPa) | 0.51 | 0.52 | 0.51 | 0.28 | 0.29 |
| Temperature (° C.) | −175.7 | −173.9 | −179.6 | −180.2 | −173.4 |
| Vapor fraction (mole) | 1.0 | 0.0 | 0.0 | 0.0 | 1.0 |

Although the present invention has been described as to specific embodiments or examples, it is not limited thereto, but may be changed or modified into any of various other forms without departing from the scope of the invention as defined in the accompanying claims.

I claim:

1. A process for producing a carbon monoxide-containing product from a feed containing hydrogen, carbon monoxide, methane, nitrogen and optionally argon, the process comprising:

partially condensing the feed to provide a first hydrogen-enriched vapor fraction and a first hydrogen-depleted liquid fraction;

stripping hydrogen from the first hydrogen-depleted liquid fraction in a first fractionator to form a second hydrogen-enriched vapor fraction and a hydrogen-freed liquid fraction;

separating at least a portion of the hydrogen-freed liquid fraction in a second fractionator to form a nitrogen-enriched vapor fraction and a nitrogen-depleted liquid fraction containing carbon monoxide and methane;

separating an at least partially vaporized feed containing carbon monoxide and methane in a third fractionator to form the carbon monoxide-containing product and a methane-enriched liquid fraction;

cooling a portion or all of the nitrogen-enriched vapor fraction by indirect heat exchange with a portion of the nitrogen-depleted liquid fraction and by indirect heat exchange with a portion or all of the methane-enriched liquid fraction to form a condensate from the portion or all of the nitrogen-enriched vapor fraction, and to form the at least partially vaporized feed from the portion of the nitrogen-depleted liquid fraction, and to form a vapor boil-up and a methane-containing bottoms product from the portion or all of the methane-enriched liquid fraction;

introducing at least a portion of the vapor boil-up to the third fractionator to provide stripping vapor; and introducing at least a portion of the condensate to the second fractionator as reflux.

2. The process as in claim 1 further comprising:

partially condensing the first hydrogen-enriched vapor fraction by indirect heat exchange against one or more process streams to form a hydrogen-containing condensate; and introducing at least a portion of the hydrogen-containing condensate to the first fractionator as reflux.

3. The process as in claim 1 further comprising:

compressing a portion or all of the carbon monoxide-containing product to form a compressed carbon monoxide-containing product;

at least partially condensing a portion of the compressed carbon monoxide-containing product to form a condensed carbon monoxide-containing stream; and introducing at least a portion of the condensed carbon monoxide-containing stream into the third fractionator as reflux.

4. The process as in claim 1 wherein the feed is partially condensed to further form a second hydrogen-depleted liquid fraction in addition to the first hydrogen-enriched vapor fraction and the first hydrogen-depleted liquid fraction, the process further comprising:

introducing the first hydrogen-depleted liquid fraction into the first fractionator at a first location; and introducing the second hydrogen-depleted liquid fraction into the first fractionator at a second location below the first location.

5. The process as in claim 4 further comprising:

heating the second hydrogen-depleted liquid fraction prior to introducing the second hydrogen-depleted liquid fraction into the first fractionator.

6. The process as in claim 1 wherein the at least partially vaporized feed further contains argon and wherein a portion of the argon is removed in the methane-enriched liquid fraction.

7. An apparatus for producing a carbon monoxide-containing product from a feed containing hydrogen, carbon monoxide, methane and nitrogen by the process as defined in claim 1, the apparatus comprising:

a first heat exchanger for cooling and partially condensing the feed to produce a cooled and partially condensed feed;

a separator for separating the cooled and partially condensed feed to produce a first hydrogen-enriched vapor fraction and a first hydrogen-depleted liquid fraction;

a first fractionator for stripping hydrogen from the first hydrogen-depleted liquid to form a second hydrogen-enriched vapor fraction and a hydrogen-freed liquid fraction from the first hydrogen-depleted liquid fraction;

a first conduit constructed and arranged to introduce the first hydrogen-depleted liquid fraction from the separator to the first fractionator;

a second fractionator for separating at least a portion of the hydrogen-freed liquid fraction to form a nitrogen-enriched vapor fraction and a nitrogen-depleted liquid fraction containing carbon monoxide and methane;

a second conduit constructed and arranged to introduce the at least a portion of the hydrogen-freed liquid fraction from the first fractionator to the second fractionator;

a third fractionator for separating an at least partially vaporized feed containing carbon monoxide and methane to form the carbon monoxide-containing product and a methane-enriched liquid fraction;

a second heat exchanger for cooling a portion or all of the nitrogen-enriched vapor fraction by indirect heat exchange with a portion of the nitrogen-depleted liquid fraction and by indirect heat exchange with a portion or all of the methane-enriched liquid fraction to form a condensate from the portion or all of the nitrogen-enriched vapor fraction, and to form the at least partially vaporized feed from the portion of the nitrogen-depleted liquid fraction, and to form a vapor boil-up and a methane-containing bottoms product from the portion or all of the methane-enriched liquid fraction;

a third conduit constructed and arranged to introduce the portion of the nitrogen-depleted liquid fraction to the second heat exchanger;

a fourth conduit constructed and arranged to introduce the at least partially vaporized feed from the second heat exchanger to an intermediate portion of the third fractionator;

a fifth conduit constructed and arranged to introduce the portion or all of the methane-enriched liquid fraction from the third fractionator to the second heat exchanger;

a sixth conduit constructed and arranged to introduce the vapor boil-up from the second heat exchanger to the third fractionator to provide stripping vapor;

a seventh conduit constructed and arranged to introduce the portion or all of the nitrogen-enriched vapor fraction from the second fractionator to the second heat exchanger; and an eighth conduit constructed and arranged to introduce the condensate from the second heat exchanger to the second fractionator as reflux.

8. The apparatus of claim 7 wherein the second heat exchanger partially condenses the first hydrogen-enriched vapor fraction by indirect heat exchange with the portion of the nitrogen-depleted liquid fraction and the portion or all of the methane-enriched liquid fraction to form a hydrogen-containing condensate from the first hydrogen-enriched vapor fraction, and further comprising:

a ninth conduit constructed and arranged to introduce the first hydrogen-enriched vapor fraction from the separator to the second heat exchanger and a tenth conduit constructed and arranged to introduce the hydrogen-containing condensate from the second heat exchanger to the first fractionator as reflux.

9. The apparatus of claim 7 further comprising:

a compressor for compressing a portion or all of the carbon monoxide-containing product to form a compressed carbon monoxide-containing product;

an eleventh conduit constructed and arranged to introduce the portion or all of the carbon monoxide-containing product from the third fractionator to the compressor;

a twelfth conduit constructed and arranged to introduce a portion of the compressed carbon monoxide-containing product from the compressor to the first heat exchanger for at least partially condensing the portion of the compressed carbon monoxide-containing product to form a carbon monoxide-containing condensate; and a thirteenth conduit constructed and arranged to introduce the carbon monoxide-containing condensate from the first heat exchanger to the third fractionator as reflux.

10. The apparatus of claim 9 further comprising:

an expansion means arranged between the first heat exchanger and the third fractionator to partially flash the carbon monoxide-containing condensate.

11. An apparatus for producing a carbon monoxide-containing product from a feed containing hydrogen, carbon monoxide, methane and nitrogen, the apparatus comprising:

a first heat exchanger for cooling and partially condensing the feed to produce a cooled and partially condensed feed;

a separator for separating the cooled and partially condensed feed to produce a first hydrogen-enriched vapor fraction and a first hydrogen-depleted liquid fraction;

a first fractionator for stripping hydrogen from the first hydrogen-depleted liquid to form a second hydrogen-enriched vapor fraction and a hydrogen-freed liquid fraction from the first hydrogen-depleted liquid fraction;

a first conduit constructed and arranged to introduce the first hydrogen-depleted liquid fraction from the separator to the first fractionator;

a second fractionator for separating at least a portion of the hydrogen-freed liquid fraction to form a nitrogen-enriched vapor fraction and a nitrogen-depleted liquid fraction containing carbon monoxide and methane;

a second conduit constructed and arranged to introduce the at least a portion of the hydrogen-freed liquid fraction from the first fractionator to the second fractionator;

a third fractionator for separating an at least partially vaporized feed containing carbon monoxide and methane to form the carbon monoxide-containing product and a methane-enriched liquid fraction;

a second heat exchanger for cooling a portion or all of the nitrogen-enriched vapor fraction by indirect heat exchange with a portion of the nitrogen-depleted liquid fraction and by indirect heat exchange with a portion or all of the methane-enriched liquid fraction to form a condensate from the portion or all of the nitrogen-enriched vapor fraction, and to form the at least partially vaporized feed from the portion of the nitrogen-depleted liquid fraction, and to form a vapor boil-up and a methane-containing bottoms product from the portion or all of the methane-enriched liquid fraction;

a third conduit constructed and arranged to introduce the portion of the nitrogen-depleted liquid fraction to the second heat exchanger;

a fourth conduit constructed and arranged to introduce the at least partially vaporized feed from the second heat exchanger to an intermediate portion of the third fractionator;

a fifth conduit constructed and arranged to introduce the portion or all of the methane-enriched liquid fraction from the third fractionator to the second heat exchanger;

a sixth conduit constructed and arranged to introduce the vapor boil-up from the second heat exchanger to the third fractionator to provide stripping vapor;

a seventh conduit constructed and arranged to introduce the portion or all of the nitrogen-enriched vapor fraction from the second fractionator to the second heat exchanger and an eighth conduit constructed and arranged to introduce the condensate from the second heat exchanger to the second fractionator as reflux.

* * * * *